US006592050B2

(12) United States Patent
Boecking

(10) Patent No.: US 6,592,050 B2
(45) Date of Patent: Jul. 15, 2003

(54) PRESSURE-CONTROLLED INJECTOR WITH VARIO-REGISTER INJECTION NOZZLE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/893,433

(22) Filed: Jun. 29, 2001

(65) Prior Publication Data

US 2002/0023970 A1 Feb. 28, 2002

(30) Foreign Application Priority Data

Jun. 29, 2000 (DE) ..... 100 31 579

(51) Int. Cl.[7] ..... B05B 3/00; F02M 47/02; F02M 59/00; F02M 61/08; F02M 61/20

(52) U.S. Cl. ..... 239/96; 239/88; 239/533.2; 239/533.7; 239/533.9

(58) Field of Search ..... 239/96, 88, 533.2, 239/533.3, 533.7, 533.9, 124, 126, 585.1, 585.4, 585.5, 89; 251/129.06, 127, 129.15; 123/467, 446

(56) References Cited

U.S. PATENT DOCUMENTS

| | | | | |
|---|---|---|---|---|
| 3,921,604 A | * | 11/1975 | Links | 123/139 E |
| 6,073,608 A | * | 6/2000 | Krieger et al. | 123/299 |
| 6,076,800 A | * | 6/2000 | Heinz et al. | 251/129.06 |
| 6,085,719 A | * | 7/2000 | Heinz et al. | 123/300 |
| 6,446,608 B1 | * | 9/2002 | Rizk | 123/467 |

* cited by examiner

*Primary Examiner*—Davis Hwu
(74) *Attorney, Agent, or Firm*—Ronald E. Greigg

(57) ABSTRACT

A pressure-controlled injector for injection systems for injecting fuel that is at high pressure into combustion chambers of internal combustion engines. A 3/2-way valve body is provided, which communicates with an inlet for fuel from a high-pressure collection chamber (common rail). The nozzle chamber of a nozzle needle can also be acted upon by fuel at high pressure. The stroke motion of the nozzle needle can be achieved via a hydraulic control chamber that can be pressure-relieved via a control line that has an externally actuatable control element.

9 Claims, 1 Drawing Sheet

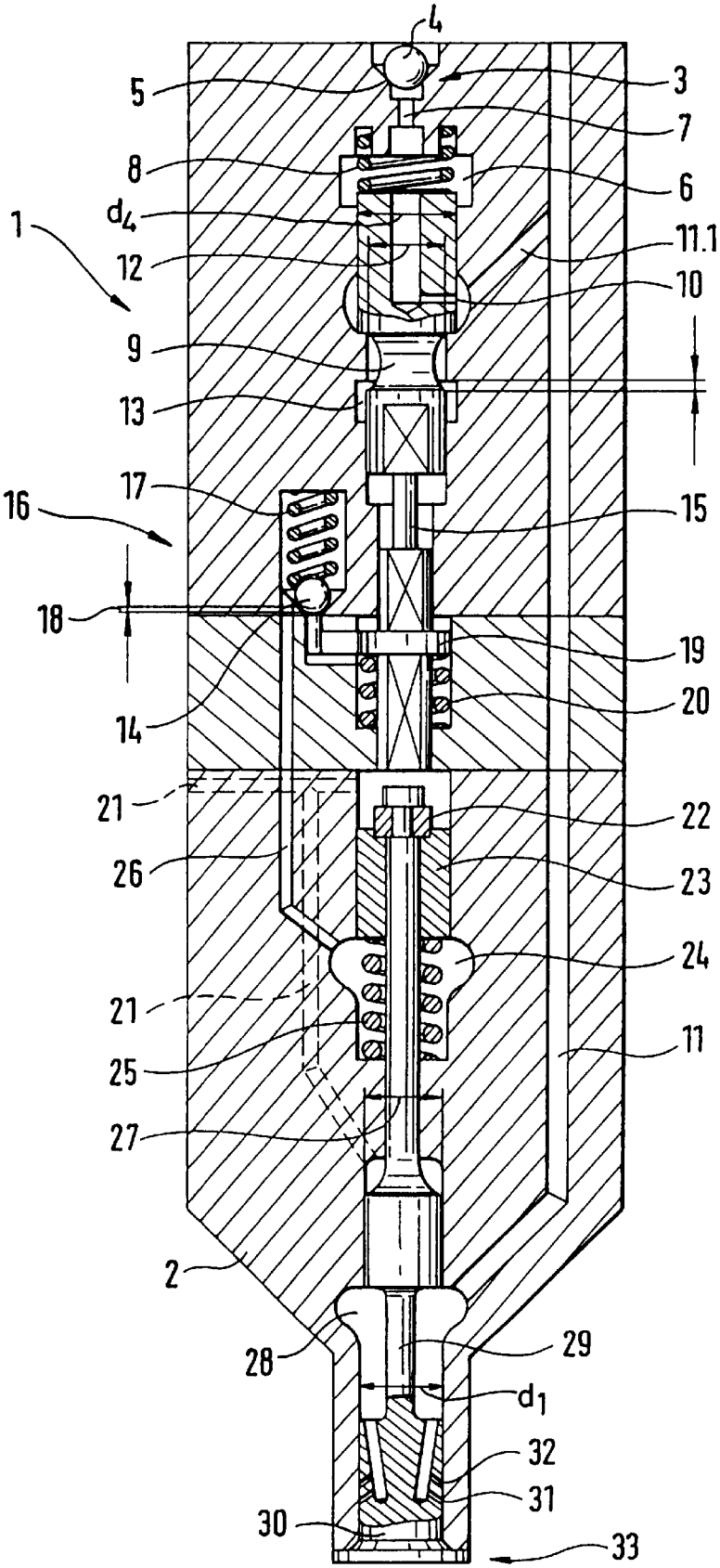
4
5
3
7
8
6
d4
11.1
1
12
10
9
13
17
15
16
18
19
20
14
21
22
26
23
24
21
11
25
27
2
28
29
d1
32
31
30
33

PRESSURE-CONTROLLED INJECTOR WITH VARIO-REGISTER INJECTION NOZZLE

BACKGROUND OF THE INVENTION

1. Field of the Invention

In injection systems for direct-injection internal combustion engines, nozzles can be used in which, depending on the stroke length of the nozzle needle in the injector body, a certain number of openings on the nozzle needle tip, which delivers the fuel that is at high pressure to the combustion chambers, are opened or closed. Depending on the vertical position of the nozzle needle in the injector body surrounding it, in lesser quantity a fuel that is at high pressure, depending on the openings that are opened or closed, is injected into the combustion chamber during the preinjection phase, or a greater injection quantity is injected during the main injection phase.

2. Description of the Prior Art

In injection systems for direct-injection internal combustion engines, a preinjection phase and the ensuing main injection phase can be achieved by means of a different vertical stroke length of the nozzle needle in the injector body surrounding it. In injection nozzles whose nozzle needle has a number of bores or openings, some of these openings can be closed by part of the injector body housing by means of how a partial stroke length is set, and after a total stroke of the nozzle needle has been executed relative to the injector body can be opened again, so that upon completion of the total stroke length, all the openings of the nozzle needle tip are opened, and to all these openings, fuel that is at extremely high pressure can be injected into the combustion chambers of an internal combustion engine. Thus during the main injection phase, the nozzle needle can be brought into a vertical stroke position in which fuel reaches the combustion chamber of an engine through all the openings, while on the other hand a partial stroke can also be established in which during the preinjection phase a lesser injection quantity is injected into the combustion chambers of the engine.

To establish the partial stroke length, a stop is required, which keeps the nozzle needle in the injector body, in the position in the valve housing that maintains the partial stroke, during the preinjection phase. A stop realized by mechanical means is exposed to major stresses on material that can lead to premature wear. Premature wear of a mechanical stop face means that an axial play of the nozzle needle will ensue. This can lead to fluctuations in the injection quantity to be injected into the various combustion chambers of the engine, but this injection quantity is defined with extreme precision in the context of a preinjection phase. Fluctuations in the fuel quantity to be injected impair the metering accuracy of an injection nozzle. The wear that occurs can also cause premature failure of the entire injection nozzle unit.

OBJECT AND SUMMARY OF THE INVENTION

With the version proposed by the invention for creating a hydraulic stop, on the one hand an essentially wear-free adjustment of a partial stroke length of the nozzle needle can be attained, and on the other, by an external opening of the control element that brings about the partial stroke position, the instant when the axial stroke length that defines the partial stroke of the nozzle needle is cancelled can be selected freely.

With the externally actuatable control element provided according to the invention, a flexible adjustment of a graduated opening of a register nozzle can be provided, so that depending on the different degree of opening—dictated by the axial stroke position of the nozzle needle—a controlled uncovering of the openings at the nozzle tip of the nozzle needle can occur.

The external actuation of the control element that accomplishes and defines the partial stroke adjustment of the nozzle needle makes it possible to choose the instant of the partial stroke adjustment of the nozzle needle and also makes it possible to use a 3/2-way control valve for common rail applications, on the control parts of which a vertical motion can be impressed by way of the stressing or unstressing of an outlet-side control part by means of an attendant pressure drop in the control chamber.

BRIEF DESCRIPTION OF THE DRAWING

The invention will be better understood and further objects and advantages thereof will become more apparent from the ensuing detailed description of a preferred embodiment taken in conjunction with the drawing, in which:

FIG. 1, the sole FIGURE of the drawing, shows the essentially vertically axially extending disposition of a pressure-controlled injector in longitudinal section with a 3/2-way valve body, an externally actuated control element, a control chamber with a control piston, and a nozzle needle extending from the control piston that has a plurality of injection openings.

DESCRIPTION OF THE PREFERRED EMBODIMENT

FIG. 1 shows the pressure-controlled injector, positioned essentially in an elongated arrangement, which in its upper region includes a 3/2-way valve, a control element that can be triggered thereby, and a control chamber with a control piston. A nozzle needle extending from the control piston and having a plurality of outlet openings provided on the nozzle needle head injects the fuel, which is at high pressure, into the combustion chamber of an internal combustion engine.

On the outlet side in the upper region of the injector 1, an actuator-actuated control valve 3 is provided in the injector housing 2. The actuator-actuatable control valve 3 can be pressure-relieved or subjected to pressure by means of an electromagnet, to which current must be supplied, or a piezoelectric actuator with extremely short response times. The actuator-actuated control valve, in the configuration shown in FIG. 1, is formed by a ball 4, which is received in a seat face 5. From the seat face, an outlet throttle 7 extends into a control chamber 6. Inside the control chamber 6, into which the upper end face protrudes with the diameter $d_4$ of a 3/2-way control valve body, a sealing spring 8 is let in, which is braced on one end on the upper end face of the 3/2-way valve body and on the other has its abutment in an annular groove on the control chamber 6.

A supply line 11, extending from the high-pressure collection chamber (common rail)—which is not shown in further detail here—extends parallel to the line of symmetry of the injector 1 shown; with a branch 11.1, it discharges into the valve chamber surrounding a 3/2-way control valve body 9 and on the other, it discharges into a nozzle chamber 28, which surrounds the nozzle needle 29 in the lower part of the injector housing 2.

The vertically movable 3/2-way control valve body 9 received in the upper part of the injector in FIG. 1 is connected in the region of the supply line 11.1 to an inlet throttle 10 and has a tapered region embodied with a diameter $d_3$ that adjoins the diameter $d_4$. In the region of the diameter $d_3$, also identified in the drawing by reference numeral 12, a release gap 13 is provided. A pressure bolt 15, which acts on a transmission element 19, is located on the underside of the 3/2-way control valve body 9.

The transmission element 19 is prestressed on its underside via a spring 20 and protrudes laterally past the line of symmetry of the injector 1. By means of the transmission element 19, a ball 14 acting as a sealing face can lift out of its sealing seat, or be pressed into the sealing seat by the spring element received 17 in the control element 16, in accordance with the stroke length 18. A control line 26 discharges laterally into the control element 16 and extends from the control chamber 24 of fixed rigidity disposed in the lower region of the injector housing 2. Accordingly, the transmission element 19 is prestressed from below by the spring 20 and can be moved by the 3/2-way control valve body upon actuation via the pressure bolt 15, while the ball acting as a sealing face is actuatable on one side via the transmission element 19, counter to the high pressure present in the control chamber 24 via the control line 26 and counter to the sealing spring 17.

A leaking oil line 21 branches laterally off from the hollow chamber receiving the control piston 23 and this line furthermore communicates with a hollow chamber in the lower region of the injector housing 2, in which a part of the nozzle needle 29 embodied with a diameter 27 ($d_2$) moves vertically.

In the hollow chamber that receives the control piston 23, the upper region of the nozzle needle 29 is shown, which extends from the control piston 23 through the control chamber 24 in the nozzle chamber 28, which can be acted upon via the supply line 11 with fuel at high pressure, as far as the inside of the region of the injector 1 protruding into the combustion chamber. In the control chamber 24, a sealing spring element 25 acting on the control piston 23 is received, which acts on the control piston 23 in such a way that by it, the nozzle needle 1 is moved back into its closing position. Branching off from the control chamber 24—as already noted—is the control line 26 to the control element 16. Through the control line 26, the pressure prevailing in the control chamber 24 also prevails in the particular hollow chamber of the control element 16 in which the compression spring 17 acting on the sealing face 14 is received as well.

The register nozzle 30 embodied on the lower end of the nozzle needle 29 is embodied with a diameter $d_1$, while the aforementioned middle portion of the nozzle needle 29 is embodied with a somewhat smaller diameter 27 ($d_2$). As a result of the pressure shoulder provided in this way at the nozzle needle 29, upon an inflow of fuel at high pressure via the supply line 11 into the nozzle chamber 28, a projection of the nozzle needle 29 in the vertical direction can be attained, counter to the compression spring 25 received in the control chamber 24. A first injection shoulder 31, for instance for performing a preinjection at a partial stroke position of the nozzle needle 29, and a second pair of injection openings inside a second injection shoulder 32 are shown schematically here at the head of the register nozzle 30. Upon a projection motion of the register nozzle head 30 out of the register head that surrounds it in the state shown, the injection quantity, for instance in the context of a preinjection phase, accordingly first exits from the openings in the first injection nozzle into the combustion chamber of the engine. If the register nozzle 30 is projected farther out of the valve housing 2, the openings of both injection shoulders 31 and 32 protrude into the combustion chamber of an internal combustion engine. For the sake of completeness, it should be noted that reference numeral 33 indicates the opening of the injector housing 2 into the combustion chamber of an internal combustion engine.

The aforementioned diameter graduation between the diameter 27 in the middle region of the nozzle needle 29 and the diameter $d_1$ of the register nozzle creates a pressure shoulder that upon action on the nozzle chamber 28 by fuel at high pressure emerging from the high-pressure collection chamber through the supply line 11 effects a projection of the register nozzle 30 into the combustion chamber and an injection of fuel. As a result, the control piston secured to the upper region of the nozzle needle 29 moves part way into the control chamber 24, and as a result braking of the projection motion of the nozzle needle out of the injector housing 2 occurs. A slight pressure increase in the control chamber 24 is associated with the projection motion of the control piston 23 out of its guidance into the control chamber, and this pressure increase acts on the control element 16 via the control line 26. As a result, the register nozzle 30 is retained in a vertical position, which corresponds to a partial stroke in the axial direction. This partial stroke position and the resultant projection motion of the first injection shoulder into the combustion chamber of an engine is maintained until such time as the pressure in the control chamber 24 is not relieved by the control element 16. If conversely a pressure relief of the control chamber 24 takes place by opening of the control element 16 by the uncovering of its seat face 14 by externally actuated triggering of the 3/2-way valve body via the control part 3 provided on the outlet side, then the nozzle needle 29 moves all the way out of the injector housing 2, which tapers to a sharp point, and as a result both injection shoulders 31 and 32 protrude into the combustion chamber of the engine, and in the context of a main injection phase, for instance, a greater quantity of fuel that is at high pressure can be injected into the combustion chamber.

The external actuation, that is, the opening of the sealing face 14 and the control element 16, accordingly takes place by a vertical motion of the 3/2-way control valve body 9 and its bore in the injector housing 2, by means of an electromagnetically effected pressure relief of the ball 4 and thus a pressure relief of the control chamber 6, or via a triggering of a piezoelectric actuator, which has an extremely short response time. This assures that by the disposition of a pressure bolt 15, the vertical motion of the 3/2-way valve let, body 9 upon pressure relief of the control chamber is transmitted to the transmission element 19, which in turn assures an uncovering of the sealing face 14 in the control element 16, and as a result the pressure prevailing in the control chamber 24 is relieved. The pressure prevailing in the control chamber 24 reinforces the force that is exerted on the control piston 23 by the sealing spring element provided in the control chamber 24.

Because of the external actuation of the control element 16, which can be embodied for instance as a trigger valve, the instant of pressure relief of the control chamber 24 can be established and preselected, freely and independently of the pressure level prevailing in the high-pressure supply line 11 and 11.1, at which the control element 16, by opening of the control element 16 with the sealing face 14 via the transmission element 19 pressure-relieves the control chamber 24. Thus the instant of pressure relief of the control chamber 24 can be determined freely, and as a result the instant between a preinjection phase and a main injection phase can be determined.

The foregoing relates to preferred exemplary embodiments of the invention, it being understood that other variants and embodiments thereof are possible within the spirit and scope of the invention, the latter being defined by the appended claims.

I claim:

1. A pressure-controlled injector for injection systems, for injecting fuel that is at high pressure into combustion chambers of internal combustion engines, the injector having a 3/2-way valve body (9), having an inlet (11), which communicates with a high-pressure collection chamber for fuel that is at high pressure, and having a nozzle needle (29) whose nozzle chamber (28) can also be acted upon by fuel that is at high pressure, the improvement comprising a hydraulic chamber (24) with an externally actuatable control element (16), which chamber controls the stroke motion of the nozzle needle (29), can be pressure-relieved, wherein the 3/2-way valve (9) is actuatable independently of the control element (16).

2. The pressure-controlled injector of claim 1, wherein said 3/2-way valve (9) is disposed in the upper region of the injector (1) and actuates a prestressed transmission element (19).

3. The pressure-controlled injector of claim 2, wherein said transmission element (19) opens and closes said control element (16).

4. The pressure-controlled injector of claim 1, wherein pressure in said hydraulic control chamber (24) is present at the control element (16) via a control line (26).

5. The pressure-controlled injector of claim 1, wherein a nozzle chamber (28) and the 3/2-way valve body (9) communicate with the supply line (11) from the high-pressure collection chamber (common rail).

6. The pressure-controlled injector of claim 1, wherein the diameter (27) $d_2$ of the nozzle needle (29) is dimensioned to be less than the diameter $d_1$ of the register nozzle (30), and as a result a pressure shoulder is created.

7. The pressure-controlled injector of claim 4, wherein the pressure present in the hydraulic control chamber (24) fixes the nozzle needle (29) and, when a sealing face (14) at the control element (16) is closed, fixes the stroke position of the nozzle needle (29) in the partial stroke position.

8. The pressure-controlled injector of claim 1, wherein said 3/2-way control valve that can be acted upon by the fuel that is at high pressure is actuatable by means of an actuator-actuated control part (3), associated with it, on the outlet side.

9. The pressure-controlled injector of claim 1, wherein said the 3/2-way valve body (9) and the control chamber (28) of the nozzle needle (29) communicate jointly with the supply line (11, 11.1) from the high-pressure collection chamber (common rail) but are controllable independently of one another.

* * * * *